United States Patent [19]

Sakurai et al.

[11] Patent Number: 5,011,401

[45] Date of Patent: Apr. 30, 1991

[54] ELASTIC ROTATABLE MEMBER AND FIXING APPARATUS

[75] Inventors: Masaaki Sakurai, Yokohama; Iichiro Yamamoto, Niiza; Masahiro Goto, Kawasaki; Tsukasa Kuge; Michio Shigenobu, both of Tokyo, all of Japan

[73] Assignee: Canon Kabushiki Kaisha, Tokyo, Japan

[21] Appl. No.: 522,460

[22] Filed: May 14, 1990

Related U.S. Application Data

[63] Continuation of Ser. No. 432,403, Nov. 6, 1989, abandoned, which is a continuation of Ser. No. 358,463, May 30, 1989, abandoned, which is a continuation of Ser. No. 94,418, Sep. 9, 1987, abandoned.

[30] Foreign Application Priority Data

Sep. 13, 1986 [JP] Japan ..... 61-216928

[51] Int. Cl.[5] ..... F27B 9/28

[52] U.S. Cl. ..... 432/60; 355/282; 219/469; 29/110; 29/132

[58] Field of Search ..... 29/110, 132, 121.3, 29/121.5, 121.6; 432/60, 228; 219/469; 355/3 FU

[56] References Cited

U.S. PATENT DOCUMENTS

| | | | |
|---|---|---|---|
| 3,785,286 | 1/1974 | Giori | 29/132 |
| 4,054,685 | 10/1977 | Giori | 29/132 |
| 4,078,286 | 3/1978 | Takiguichi et al. | 29/132 |
| 4,084,500 | 4/1978 | Brown et al. | 29/132 |
| 4,198,739 | 4/1980 | Budinger et al. | 29/132 |
| 4,632,855 | 12/1986 | Conlon et al. | 29/132 |
| 4,700,450 | 10/1987 | Michel | 29/132 |

FOREIGN PATENT DOCUMENTS

| | | |
|---|---|---|
| 61-22377 | 7/1984 | Japan . |
| 61-250668 | 4/1985 | Japan . |
| 61-83567 | 4/1986 | Japan . |

*Primary Examiner*—Henry C. Yuen

*Attorney, Agent, or Firm*—Fitzpatrick, Cella, Harper & Scinto

[57] ABSTRACT

An elastic rotatable member conveniently usable as an image fixing member has a base member, a first primer layer, an elastic layer, a second primer layer and a resin layer in the order named. The first primer layer has a thermal conductivity higher than that of the second primer layer. Using the elastic rotatable member, its sheet conveying properties, releasability, wear resistance and durability are improved. When used for an image fixing rotatable member, its image fixing properties are improved.

34 Claims, 2 Drawing Sheets

ELASTIC ROTATABLE MEMBER AND FIXING APPARATUS

This application is a continuation of application Ser. No. 432,403, filed Nov. 6, 1989, which was a continuation of application Ser. No. 358,463, filed May 30, 1989, which was a continuation of application Ser. No. 094,418, filed Sept. 9, 1987, all now abandoned.

FIELD OF THE INVENTION AND RELATED ART

The present invention relates to an elastic rotatable member usable in various image forming apparatuses such as an electrophotographic copying machine and laser beam printer. More particularly the present invention relates to an elastic rotatable member conveniently usable for a conveying a roller for conveying transfer sheets or recording materials in an image forming apparatuses and an image fixing roller for fixing a toner image on the transfer sheets or recording materials in the image forming apparatus. The present invention also relates to an image fixing apparatus using such an elastic rotatable member. Since the elastic rotatable member according to the present invention is most conveniently usable as an image fixing roller in an image fixing apparatus, the following description will be mainly directed to an image fixing roller or an image fixing device.

Conveying rollers are known in the field of the image forming apparatus such as in electrophotographic copying machines such conveying rollers convey along a predetermined passage a transfer sheet or recording material which is usually a paper sheet. They are required to have a conveying property, releasability and durability. Among various conveying rollers, an image fixing roller is required to have those properties and wear resistance and an image fixing property under more severe conditions, since it applies heat to an unfixed toner image on the transfer sheet and conveys the transfer sheet to a predetermined passage while preventing toner off-set.

In the field of the image fixing techniques, a heat-fixing roller for directly contacting the toner image comprises a core metal coated with a resin layer such as tetrafluoroethylene resin or the like, and a pressing roller press-contacts the heat-fixing roller to increase the heating period for the toner image and comprises a roller coated with a rubber layer. The recording material such as paper supporting a toner image is passed through a nip region established by the pair of rollers.

However, since the surface of the heat-fixing roller contacting the toner image is almost a rigid body, it does not follow any unsmoothness of the paper surface or the toner image, with the result that the heat is not transferred efficiently when the toner image is pressed. The ability to fix the image and the image quality are worse than when a rubber roller is used at the toner contacting side. Additionally, there is recognized more low temperature off-set because of the decreased ability to fix the image. Further, curling and wrinkles of the paper by the toner image fixing under high humid conditions are more remarkable than when the rubber roller is used at the toner image contacting side.

Where, however, a rubber roller is used as a roller for contacting the toner image, the releasability property of the surface of the roller easily changes with time, and therefore, it exhibits good releasability with very little toner offset at an initial stage of use, but the releasability gradually deteriorates with the number of operations. Once the roller is contaminated by toner, it is difficult to remove it from the roller by a cleaning member, so that the off-set rapidly increases. Also, when a rubber roller is used, the roller surface is easily worn by a member or members disposed in contact with a sheet separation pawl and a temperature sensor, because the wear resistance thereof is low. If this occurs, localized insufficient image fixing and localized toner off-set are increased.

As described above, the rubber roller and the resin roller have their own advantages and also corresponding disadvantages. An elastic roller having the advantages of the rubber roller and the resin roller are desired.

To satisfy this desire, proposals have been made to provide a roller having an elastic rubber layer and a resin layer thereon in U.S. Ser. Nos. 793,546 filed on Oct. 31, 1985, 831,729 filed on Feb. 21, 1986 and 877,849 filed on June 24, 1986. The rollers disclosed in those applications exhibit surface resin property, a sufficient total elasticity, fixiativeness, wear resistance and releasability, which are better than those in the prior art.

Still, an improvement of such a roller is desired in the bonding strength between the elastic rubber layer and the resin layer and in the thermal deterioration resulting when the resin layer is formed on the elastic rubber layer by sintering.

SUMMARY OF THE INVENTION

Accordingly, it is a principal object of the present invention to provide an elastic rotatable member for conveying sheet-like material such as a paper sheet which exhibits a good conveying property, releasability, wear resistance and durability and to provide an image fixing apparatus using the same roller as an image fixing rotatable member, which exhibits a good image fixing property.

It is another object of the present invention to provide an elastic rotatable member and an image fixing apparatus using the same wherein the occurrences of the curling and wrinkle of the sheet-like material are significantly reduced.

It is a further object of the present invention to provide an elastic rotatable member and an image fixing apparatus wherein the bonding between the elastic layer and the resin layer is improved.

It is a further object of the present invention to provide an elastic rotatable member and an image fixing apparatus wherein when the resin layer is formed outside the elastic layer, the elastic layer is prevented from thermal deterioration.

It is a further object of the present invention to provide an image fixing apparatus having an elastic rotatable member exhibiting good image fixing properties.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
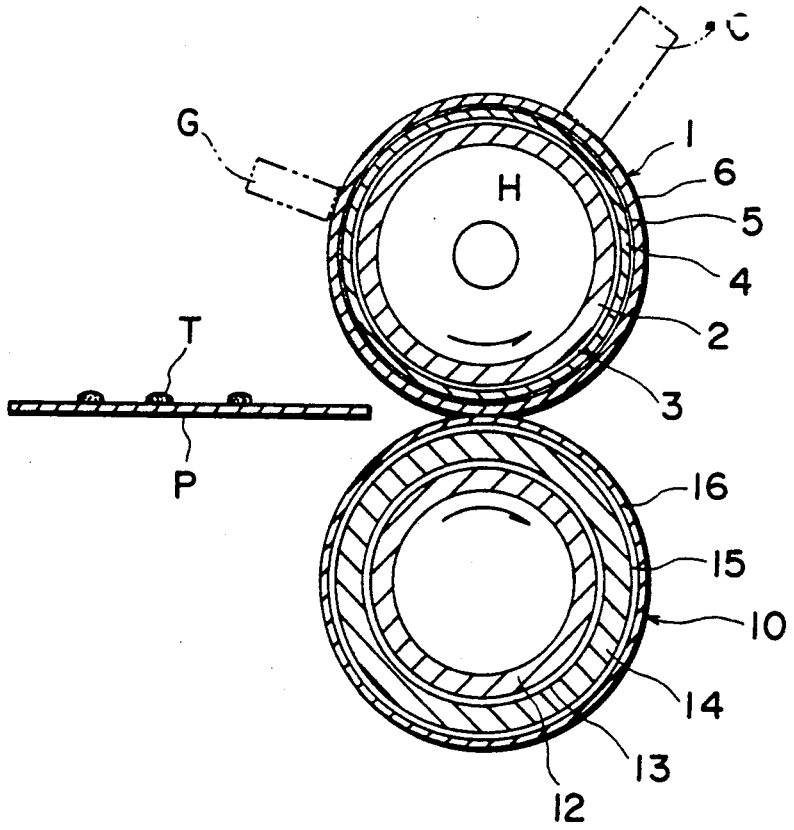
FIG. 1 is a sectional view of an image fixing apparatus using the elastic rotatable member according to an embodiment of the present invention.
Figure 2:
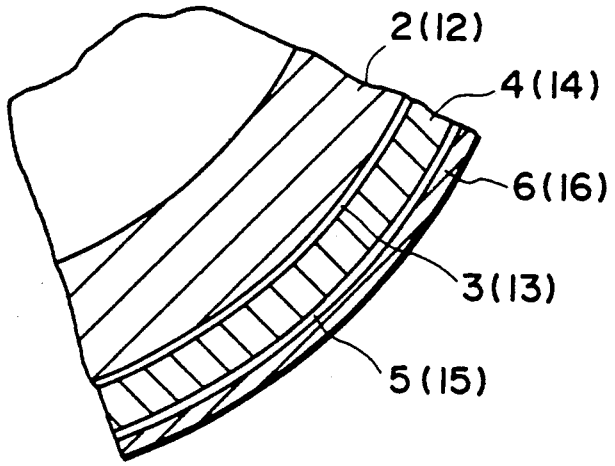
FIG. 2 is a sectional view of rollers.

Referring to FIG. 1, there is shown an electrophotographic copying machine as an example of an image forming apparatus, which includes an image fixing device for heat-fixing a toner image, using an elastic rotatable member according to this invention.

As shown in FIG. 1, the image fixing device includes a heat-fixing roller 1 which contains therein a heating source H and which is adapted to contact the toner image T supported on a transfer sheet P (an image bearing member) and a pressing roller 10 for pressing the transfer sheet P supporting the toner image T to the heat-fixing roller 1.

In this embodiment, the heat-fixing roller 1 and the pressing roller 10 have generally the same layer structure. More particularly, each of them includes a core metal 2 (12), a first primer layer 3 (13), an elastic material layer 4 (14), a second primer layer 5 (15) and a surface resin layer 6 (16) which is a surface releasing layer, in the order named. The first and second primer layers serve as a bonding layer.

The elastic layer 4 (14) is of a material having a relatively high thermal conductivity. Also, the first primer layer 3 (13) inside the elastic layer 4 (14) is of a material having a relatively high thermal conductivity. On the other hand, the second primer layer 5 (15) outside the elastic layer 4 (14) is of a material having good thermal insulation properties, that is, a relatively low thermal conductivity. The thermal conductivity of the first primer layer 3 (13) is larger than the thermal conductivity of the second primer layer 5 (15). Preferably, the thermal conductivity of the elastic layer 4 (14) is larger than the thermal conductivity of the first primer layer 3 (13).

The structures and thermal conductivities will be described in more detail hereinafter. In this embodiment, the heat fixing roller and the pressing roller have the same structure of layers, but the above structure may be incorporated into at least one of those rollers, preferably into the heat-fixing roller contacting the toner image, leaving the pressing roller to have a conventional structure.

The fixing device is provided with a temperature sensor G for detecting the surface temperature of the heat-fixing roller 1 so as to maintain the surface temperature at an optimum temperature to fuse the toner, 160°-200° C., for example and is also provided with an off-set preventing liquid applying and cleaning means C for applying off-set preventing liquid such as silicone oil or the like onto the surface of the heat-fixing roller 1 and for cleaning the surface of the heat-fixing roller.

The layer structures will be described in detail. The surface of the heat-fixing roller 1 has a core metal 2 of aluminum or the like which has a relatively good thermal conductivity and the first primer layer 3 of a silicon material which has a relatively good or high thermal conductivity, preferably has a thermal conductivity not less than $0.6\times10^{3}$ cal·cm/sec·cm$^{2}$·°C., and preferably has a layer thickness of 2-30 microns. On the first primer layer 3 is formed an elastic layer 4 of a fluorine or silicone rubber which has a relatively high thermal conductivity, i.e. preferably a thermal conductivity not less than $0.8\times10^{-3}$ cal·cm/sec·cm$^{2}$·°C., and preferably has a layer thickness of 0.3-2.0 mm. On the elastic layer 4 is formed the second primer layer 5 of a silicon or fluorine material which has relatively good thermal insulation properties and preferably has a thermal conductivity not more than $0.4\times10^{-3}$ cal·cm/sec·cm$^{2}$·°C., and preferably has a layer thickness of 5-60 microns.

On the second primer layer 5 is formed a resin layer 6 of a PFA resin (tetrafluoroethylene-perfluoroalkoxyethylene copolymer resin), PTFE resin (tetrafluoroethylene resin) or another fluorine resin which has a layer thickness of 5-35 microns and has a film strength of not less than 50 kg/cm$^{2}$.

The pressing roller 10 has the core metal 12 of stainless steel or iron or the like and the first primer layer 13 of a silicon material having a relatively high heat conductivity, preferably having a thermal conductivity not less than $0.6\times10^{-3}$ cal·cm/sec·cm$^{2}$·°C. and has a layer thickness of 2-30 microns. On the first primer layer 13 is formed an elastic layer 14 of fluorine rubber or silicone rubber which has a relatively high thermal conductivity. Layer 14 preferably has a thermal conductivity of not less than $0.8\times10^{-3}$ cal·cm/sec·cm$^{2}$·°C., and preferably has a layer thickness of 3-10 mm. On the elastic layer 14 is formed the second primer layer 15 of a silicon or fluorine material which has a relatively high thermal insulating property. Layer 15 preferably has a thermal conductivity not more than $0.4\times10^{-3}$ cal·cm/sec·cm$^{2}$·°C., and preferably has a layer thickness of 5-60 microns.

On the second primer layer 15 is formed a resin layer 16 of the PFA resin, PTFE resin or another fluorine resin, which preferably has a layer thickness of 5-35 microns and preferably has a film strength of not less than 50 kg/cm$^{2}$.

Each of the heat-fixing roller 1 and the pressing roller 10 is symmetrical about a center line between longitudinal ends, and preferably, the heat-fixing roller 1 (or the pressing roller 10) is reversely crowned, that is, the diameter in the middle between the longitudinal ends is slightly smaller than the diameters at the opposite ends.

A description will be provided with respect to the method of manufacturing the above-described heat-fixing roller 1 and the pressing roller 10.

As for the manufacturing of the heat-fixing roller 1, an aluminum core metal 2 is prepared so as to have a finished surface and have the center diameter of 58.3 mm (6.5 mm in thickness and 150 microns of the reverse-crown). The surface then is degreased by sandblasting and is dried. On the core metal 2, a silicone primer is applied in the thickness of 7 microns and is air-dried, the primer having the thermal conductivity of $0.8\times10^{-3}$ cal·cm/sec·cm$^{2}$·°C. (after the air drying). Then, a heat curing type silicone rubber sheet having a relatively high thermal conductivity ($1.5\times10^{-3}$ cal·cm/sec·cm$^{2}$·°C.) is wrapped thereon and is press-valcanized at 160° C. for 30 minutes. Thereafter, the surface is machined to provide the rubber thickness of 0.5 mm, whereby a silicone rubber roller is manufactured.

On the silicone rubber roller, a fluorine primer having a good thermal insulation property is applied in the thickness of 15 microns and is air-dried (thermal conductivity thereof is $0.2\times10^{-3}$ cal·cm/sec·cm$^{2}$·°C. (after the air drying)). PFA powder is sprayed thereon into the thickness of 20 microns. The core metal is masked with a thermal insulation member. The surface of the PFA resin is heated by infrared heating at a temperature not less than crystal fusing melting, 340° C. for example for 30 minutes to sinter the PFA coating, while cooling the inside of the core metal by air. Then, it is cooled quickly. By the cooling or quenching, the sintered fluorine resin surface layer has resin properties including a crystallinity not more than 95%, the tensile strength not less than 50 kg/cm$^2$ and contact angle with respect to water not less than 100 degrees. Further, the sintered resin layer having a sufficient thickness is strongly bonded to the rubber roller.

The sintering of the surface fluorine resin layer may be effected by using a dielectric heating method.

Figure 3:
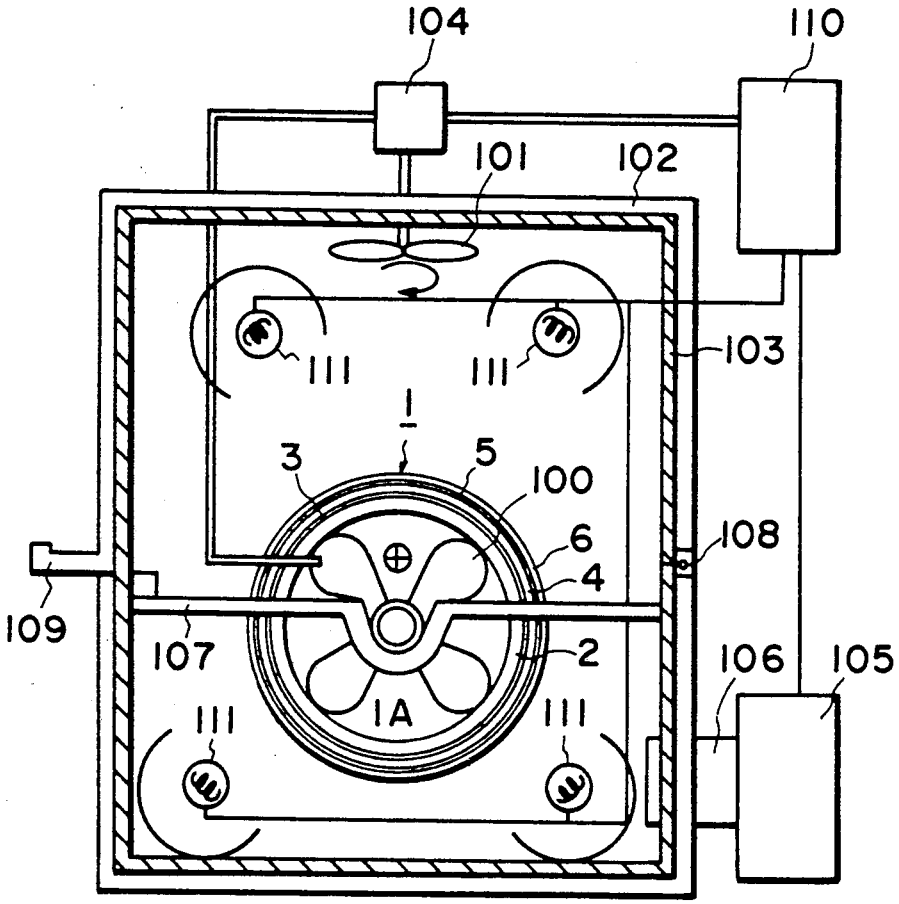
FIG. 3 is a sectional view of an example of an apparatus for manufacturing the image fixing roller.

As shown in FIG. 3, a dielectric heating device uses both dielectric heating and external infrared heating. It includes a magnetron 105, a waveguide 106 for propagating high frequency wave (950–2450 MHz) produced by the magnetron 105, an openable resin container 102 communicating with the waveguide 106 and having a metal plate 103 for reflecting the high frequency wave, and two top and two bottom infrared lamps 111 with shades for externally heating it by infrared rays.

In the resin container 102, there are provided a fan 100 for producing air flow in the inside of the follow heat-fixing roller 1 and a fan 101 for producing air flow in the container 102, both of the fans being driven by external driving means. The container is openable by rotating an upper half thereof about a pivot 108. The upper frame is provided with a grip 109, while the lower half is provided with an arm 107 for positioning a flange 1A of the roller 1.

Control means 110 controls operations of the driving means 104, the magnetron 105 and the infrared lamp 111.

Since the heat-fixing roller 1 has an inside silicone rubber layer 4 and a surface fluorine resin layer 6, the high frequency wave is mainly absorbed by the fluorine resin layer 6 since it has a larger dielectric constant than the silicone rubber layer 4. Therefore, the fluorine resin layer 6 is quickly heated by the high frequency wave and the infrared rays and also by the heat accumulated in the constant temperature oven, and is completely sintered at the temperature not lower than the crystal melting temperature of the fluorine resin, at 340° C. for example, for 15 minutes. After the sintering, the roller is quenched.

In this embodiment, the surface fluorine resin is preferably PTFE dispersion, such as those available from Daikin Kabushiki Kaisha, Japan as tetrafluoroethylene resin dispersion D-1.

By using this dielectric heating technique, the loss of energy is minimized, and in addition, the heat attack to the elastic layer is minimized. What should be considered in the manufacturing of the elastic rotatable member of the present invention is that when the unsintered resin material is heated and sintered after it is applied on the second primer layer, the elastic layer under the second primer layer is to be maintained below the temperature at which the material constituting the elastic layer is durable.

On the other hand, the pressing roller 10 is manufactured in the similar manner. The core metal 12 is of iron, but the materials of the elastic layer 14, the first and second primer layers 13 and 15 and the resin layer 16 are of the same materials as of the heat-fixing roller 1. However, the layer thicknesses of the first primer layer 13, the elastic layer 14, the second primer layer 15 and the resin layer 16 are, 7 microns, 6 mm, 15 microns and 20 microns, respectively. The outer diameter of the pressing roller 10 is the same as that of the heat-fixing roller.

For both of the heat-fixing roller 1 and the pressing roller 10, the first primer is, for example, composed of a silane coupling agent, a silane compound having a molecular weight larger than that of the silane coupling agent, catalyser, a metal powder, and red ion oxide diluted by solvent available from SHIN'ETSU KAGAKU KOGYO KABUSHIKI KAISHA. And, it is sprayed on the core metal and is air-dried. For both of the heat-fixing roller 1 and the pressing roller 10, the second primer is, for example, composed of amine silane coupling agent, and PTFE powder diluted by solvent available from SHIN'ETSU KAGAKU KOGYO KABUSHIKI KAISHA. It is sprayed on the elastic rubber layer and is air-dried.

The elastic rubber layers 4 and 14 of the heat-fixing roller 1 and the pressing roller 10 are not deteriorated by heat during the fluorine resin layer being heat-sintered, and the rubber properties thereof such as impact resilience are substantially the same as those before the sintering, which are desirable. Also, the surface layer of the fluorine resin is completely sintered and shows very good releasbility, wear resistance and the bonding strength with the elastic rubber layer.

The reason for this is considered as follows. According to this embodiment, the first primer layer below the elastic layer has a relatively high thermal conductivity, while the second primer layer on the elastic layer has a relatively low thermal conductivity, that is, a higher insulating property. Therefore, when the surface resin is sintered at a temperature not less than the resin crystal melting point to form a sintered resin layer, the second primer layer is attacked by heat, but the heat transmission to the elastic layer is retarded or substantially prevented due to the relatively higher insulation property of the second primer. Moreover, even if the heat is transmitted to the elastic layer so that the elastic layer is attacked slightly by heat, the heat is released without difficulty to the core metal through the first primer layer since the first primer layer under the elastic layer has a relatively high thermal conductivity, whereby the heat is not accumulated in the elastic layer. It is believed that the elastic layer is protected from deterioration by heat in this manner. On the other hand, the second primer layer having a relatively higher insulating property is effective to prevent transmission of heat, and therefore, sufficient thermal energy is applied to the surface resin material, whereby the resin material is completely sintered with the result of the material having a sufficient resin property.

Together with the sintering of the resin material, and with the bonding function of the second primer layer, a strong bonding strength is provided between the elastic layer and the resin layer, and therefore, the surface resin layer is not peeled off easily.

Endurance tests have been conducted using the heat-fixing roller and the pressing roller of this embodiment under the following conditions:

surface temperature of the heat-fixing roller 1: 180° C.
sheet speed: 200 m/sec
sheet feed: 30/A4 size.min Under the condition of 15° C., the ability to fix the image was good, and the occurrences of toner off-set were reduced to not more than one fifth of those in conventional devices. Further, the period between exchanging the cleaning member was increased up to not less than 5 times. Under the conditions of 32.5° C. and a relative humidity of 85%, the transfer sheets were not wrinkled, and very little curling was recognized so that the sheets were stacked in a sorter or the like in good order. Additionally, the image was hardly crushed, and the image quality was satisfactory. Those good results were maintained even after 300,000 sheets were passed through the nip between the heat-fixing roller and the pressing roller, and even after 500,000 sheets were passed therethrough.

As described, when the elastic rotatable member is used as a heat-fixing roller of an image fixing device, the good thermal conductivity of the first primer layer and the elastic layer is effective to reduce the thermal resistance against the heat from the roller inside to the outside so that the fixiativeness and the durability are improved.

Moreover, the second primer layer having a relatively low thermal conductivity is effective to provide a heat-resistance and produce a properly controlled heat flow. Therefore, in the case that a number of copies are produced continuously, the heat application to the sheets can be made uniform over the number of the copies. Without the present invention, a great amount of heat is applied to the first or first several sheets, whereas only a small amount of heat is applied to the last sheets. This is eliminated using the fixing roller according to the present invention.

According to various inventors' experiments, it has been found that it is particularly preferable in order to provide good results that the thermal conductivity of the first primer layer is not less than $0.6\times10^{-3}$ cal·cm-/sec·cm$^2$·°C.; the thermal conductivity of the elastic layer is not less than $0.8\times10^{-3}$ cal·cm/sec·cm$^2$·°C., and further preferably, not less than $1.2\times10^{31\ 3}$ cal·cm-/sec·cm$^2$·°C.; the thermal conductivity of the second primer layer is not more than $0.4\times10^{-3}$ cal·cm-/sec·cm$^2$·°C.; and further preferably, not more than $0.25\times10^{-3}$ cal·cm/sec·cm$^2$·°C.; and in addition that the thickness of the elastic layer is larger than that of the second primer layer which is in turn larger than the first primer layer, and the thickness of the elastic layer is larger than 6 times the resin layer. The thermal conductivities of the first and second primers are substantially the same irrespective of whether it is in the final product and after the air-drying.

The elastic rotatable member according to the present invention is applicable in addition to the rollers for image fixing described above, to a conveying roller, a cleaning roller and a releasing agent applying roller or the like. In any application, the releasability of the surface resin layer together with the resilience provided by the elastic layer are advantageously utilized.

The elastic rotatable member of the present invention is not limited to the form of the roller and may be in the form of a belt.

As described hereinbefore, in the elastic rotatable member according to this embodiment, the elastic layer is made of a good thermal conductivity material; the first primer layer inside the resilient layer has a good thermal conductivity; the second primer layer outside the elastic layer has a good thermal insulation property; and the surface resin layer is formed outside the second primer layer. The surface resin layer provides desirable conveying property, releasability and wear resistance and durability, while simultaneously the inside elastic layer and the first and second primer layers provide an appropriate elasticity and proper heat transmitting speed. Therefore, when it is used as a rotatable member or members for image fixing, good image fixiativeness and image quality are assured with the advantage of remarkably reducing the occurrences of curling and wrinkle.

Further, the elastic rotatable member of the present invention has the first primer layer having the thermal conductivity larger than that of the second primer layer, whereby the elastic layer inside the second primer layer is substantially released from the thermal damage due to the thermal insulating property of the second primer layer, in addition, between the elastic layer and the surface resin layer to which sufficient heat is applied, there is provided a high bonding strength to provide sufficient durability together with excellent surface releasability and surface wear resistance.

Additionally, the elastic rotatable member according to the present invention is substantially free from the deterioration of the elastic layer by heat during the sintering of the resin layer in manufacturing. Therefore, the desired and appropriate elasticity can be maintained.

While the invention has been described with reference to the structures disclosed herein, it is not confined to the details set forth and this application is intended to cover such modifications or changes as may come within the purposes of the improvements or the scope of the following claims.

What is claimed is:

1. An elastic rotatable member, comprising:

a base member;

an elastic material layer outside said base member;

a first primer layer between said base member and said elastic material layer;

a resin layer outside said elastic material layer; and a second primer layer between said elastic material layer and said resin layer;

wherein said first primer layer has a thermal conductivity which is larger than that of said second primer layer; and wherein said elastic material layer is composed of an elastic material, and the elastic material layer has a thermal conductivity which is higher than that of the first primer layer.

2. A member according to claim 1, wherein said elastic material layer is composed of silicone rubber.

3. A member according to claim 2, wherein said first primer layer is composed of a silicone primer.

4. A member according to claim 2, wherein said resin layer is composed of a fluorine resin.

5. A member according to claim 4, wherein said second primer layer is composed of a silicone or fluorine primer.

6. A member according to claim 4, wherein said resin layer comprises a resin selected from the group consisting of:

tetrafluoroethylene-perfluoroalkoxyethylene copolymer resin and tetrafluoroethylene resin.

7. A member according to claim 1, wherein said elastic rotatable member is an image fixing rotatable member for fixing an unfixed image.

8. An image fixing apparatus, comprising:

first and second rotatable members press-contacted to each other to form a nip to which an image bearing member supporting an unfixed image is passed through, during which the image is fixed;

at least one of said first and second rotatable member comprising;

a base member;

an elastic material layer outside said base member;

a first primer layer between said base member and said elastic material layer;

a resin layer outside said elastic material layer; and a second primer layer between said elastic material layer and said resin layer;

wherein said first primer layer has a thermal conductivity which is larger than that of said second primer layer; and wherein said elastic material layer is composed of an elastic material, and the elastic material layer has a thermal conductivity which is higher than that of the first primer layer.

9. An apparatus according to claim 8, wherein said elastic material layer is composed of silicone rubber.

10. An apparatus according to claim 9, wherein said first primer layer is composed of a silicone primer.

11. An apparatus according to claim 9, wherein said resin layer is composed of a fluorine resin.

12. An apparatus according to claim 11, wherein said second primer layer is composed of a silicone or fluorine primer.

13. A apparatus according to claim 11, wherein said resin layer comprises a resin selected from the group consisting of:

tetrafluoroethylene-perfluoroalkoxyethylene copolymer resin and tetrafluoroethylene resin.

14. An apparatus according to claim 8, wherein said at least one of the rotatable members is adapted to directly contact the unfixed image and is provided with heating means therein.

15. An elastic rotatable member, comprising:

a base member;

an elastic material layer outside said base member;

a first primer layer between said base member and said elastic material layer;

a resin layer, outside said elastic material layer, formed by applying and sintering resin material; and a second primer layer between said elastic material layer and said resin layer, wherein said first primer layer has a thermal conductivity which is larger than that of said second primer layer; and wherein said elastic material layer is composed of an elastic material, and the elastic material layer has a thermal conductivity which is higher than that of the first primer layer.

16. A member according to claim 15, wherein said elastic material layer is composed of silicone rubber.

17. A member according to claim 16, wherein said first primer layer is composed of a silicone primer.

18. A member according to claim 16, wherein said resin layer is composed of a fluorine resin.

19. A member according to claim 18, wherein said second primer layer is composed of a silicone or fluorine primer.

20. A member according to claim 18, wherein said resin layer comprises a resin selected from the group consisting of: tetrafluoroethylene-perfluoroalkoxyethylene copolymer resin and tetrafluoroethylene resin.

21. A member according to claim 15, wherein said elastic rotatable member is an image fixing rotatable member for fixing an unfixed image.

22. An image fixing apparatus, comprising:

first and second rotatable members press-contacted to each other to form a nip to which an image bearing member supporting an unfixed image is passed through, during which the image is fixed, at least one of said first and second rotatable members comprising:

a base member;

an elastic material layer outside said base member;

a first primer layer between said base member and said elastic material layer;

a resin layer, outside said elastic material layer, formed by applying and sintering resin material; and a second primer layer between said elastic material layer and said resin layer, wherein said first primer layer has a thermal conductivity which is larger than that of said second primer layer; and wherein said elastic material layer is composed of an elastic material, and the elastic material layer has a thermal conductivity which is higher than that of the first primer layer.

23. An apparatus according to claim 22, wherein said elastic material layer is composed of silicone rubber.

24. An apparatus according to claim 23, wherein said first primer layer is composed of a silicone primer.

25. An apparatus according to claim 23, wherein said resin layer is composed of a fluorine resin.

26. An apparatus according to claim 25, wherein said second primer is composed of a silicone or fluorine primer.

27. An apparatus according to claim 25, wherein said resin layer comprises a resin selected from the group consisting of: tetrafluoroethylene-perfluoroalkoxyethlyene copolymer resin and tetrafluoroethylene resin.

28. An apparatus according to claim 22, wherein said at least one of said rotatable members is adapted to directly contact the unfixed image and is provide with heating means therein.

29. A member according to claim 1 or 15, wherein the first primer has thermal conductivity of not less than $0.6\times10^{-3}$ cal·cm/sec·cm$^2$·°C.; said elastic material layer has a thermal conductivity of $0.8\times10^{-3}$ cal·cm/sec·cm$^2$·°C.; and said second primer has a thermal conductivity of not less than $0.4\times10^{-3}$ cal·cm/sec·cm$^2$·°C.

30. A member according to claim 29, wherein said elastic material layer has a thickness which is larger than the thickness of the second primer layer, which in turn is larger than the thickness of the first primer layer.

31. A member according to claim 30, wherein the elastic material layer has a thickness which is larger than 6 times the thickness of the resin layer.

32. An apparatus according to claim 8 or 22, wherein the first primer has thermal conductivity of not less than $0.6\times10^{-3}$ cal·cm/sec·$^2$·°C; said elastic material layer has a thermal conductivity of $0.8\times10^{-3}$ cal·cm/sec·cm$^2$·°C.; and said second primer has a thermal conductivity of not less than $0.4\times10^{-3}$ cal·cm/sec·cm$^2$·°C.

33. An apparatus according to claim 32, wherein said elastic material layer has a thickness which is larger than the thickness of the second primer layer, which in turn is larger than the thickness of the first primer layer.

34. An apparatus according to claim 33, wherein the elastic material layer has a thickness which is larger than 6 times the thickness of the resin layer.

* * * * *

UNITED STATES PATENT AND TRADEMARK OFFICE

CERTIFICATE OF CORRECTION

PATENT NO. : 5,011,401 Page 1 of 2

DATED : April 30, 1991

INVENTOR(S) : Masaaki Sakurai et al.

It is certified that error appears in the above-identified patent and that said Letters Patent is hereby corrected as shown below:

TITLE PAGE

At [73], "Assignee: Canon Kabushiki Kaisha, Tokyo, Japan" should read --Assignees: Canon Kabushiki Kaisha; and Kabushiki Kaisha I.S.T., both of Tokyo, Japan--.

COLUMN 1

Line 32, "machines" should read --machines,--.

COLUMN 3

Line 60, "$0.6 \times 10^{3}$" should read --$0.6 \times 10^{-3}$--.

COLUMN 4

Line 52, "press-valcan-" should read --press-vulcan--.

UNITED STATES PATENT AND TRADEMARK OFFICE

CERTIFICATE OF CORRECTION

PATENT NO. : 5,011,401 Page 2 of 2

DATED : April 30, 1991

INVENTOR(S) : Masaaki Sakurai et al.

It is certified that error appears in the above-identified patent and that said Letters Patent is hereby corrected as shown below:

COLUMN 5

Line 18, delete "follow".

COLUMN 6

Line 18, "releasbility" should read --releasability--.

COLUMN 7

Line 28, "$1.2 \times 10^{31\ 3}$" should read --$1.2 \times 10^{-3}$--

COLUMN 8

Line 60, "member" should read --members--.

COLUMN 10

Line 26, "second primer" should read --second primer layer--.

Signed and Sealed this

Seventeenth Day of March, 1992

*Attest:*

HARRY F. MANBECK, JR.

*Attesting Officer*

*Commissioner of Patents and Trademarks*